US008431073B2

(12) United States Patent
Hasselqvist

(10) Patent No.: US 8,431,073 B2
(45) Date of Patent: Apr. 30, 2013

(54) NICKEL BASE GAMMA PRIME STRENGTHENED SUPERALLOY

(75) Inventor: Magnus Hasselqvist, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 39 days.

(21) Appl. No.: 13/054,139

(22) PCT Filed: Jul. 8, 2009

(86) PCT No.: PCT/EP2009/058676

§ 371 (c)(1),
(2), (4) Date: Apr. 14, 2011

(87) PCT Pub. No.: WO2010/006974

PCT Pub. Date: Jan. 21, 2010

(65) Prior Publication Data

US 2011/0200443 A1 Aug. 18, 2011

(30) Foreign Application Priority Data

Jul. 14, 2008 (EP) ..... 08012691

(51) Int. Cl.
*C22C 19/05* (2006.01)

(52) U.S. Cl.
USPC ..... 420/448; 148/404; 148/410; 148/428

(58) Field of Classification Search ..... 420/448; 148/410, 428, 404
See application file for complete search history.

(56) References Cited

U.S. PATENT DOCUMENTS

| | | | | |
|---|---|---|---|---|
| 4,643,782 | A | 2/1987 | Harris et al. | |
| 4,758,480 | A * | 7/1988 | Hecht et al. | 428/680 |
| 4,764,225 | A * | 8/1988 | Shankar et al. | 148/404 |
| 5,270,123 | A | 12/1993 | Walston et al. | |
| 6,706,241 | B1 * | 3/2004 | Baumann et al. | 420/448 |

FOREIGN PATENT DOCUMENTS

| | | |
|---|---|---|
| CH | 637 165 | 7/1983 |
| EP | 0 076 360 A2 | 4/1983 |
| EP | 0 208 645 A2 | 1/1987 |

(Continued)

OTHER PUBLICATIONS

Stringer J et al: "Effect of thermal cycling on the hot corrosion of the Ni-base superalloy IN713LC" Corrosion Science, Oxford, GB, vol. 17, No. 6, Jan. 1, 1977 , pp. 529-534, XP024036254 ISSN: 0010-938X.

Sarioglu et al., "The Control of Sulfur Content in Nickel-Base, Single Crystal Superalloys and its Effects on Cyclic Oxidation Resistance", Proceedings of 8th Int Symposium on Superalloys, Sep. 22-26, 1996, pp. 71-80.

Pint et al., "Effect of Cycle Frequency on High-Temperature Oxidation Behaviour of Alumnia- and Chromia-Forming Alloys", 58 (½), 73-101 (2002), pp. 1-34.

(Continued)

*Primary Examiner* — Deborah Yee

(57) ABSTRACT

A nickel base gamma prime strengthened superalloy with a unique blend of adequate hot corrosion resistance, high oxidation resistance, high coating compatibility, adequate phase stability, adequate creep resistance and low density is disclosed. The composition includes: Up to 20 wt % Co, between 12 and 14 wt % Cr, between 1 and 2 wt % Mo, between 1.4 and 2.8 wt % W, between 5.1 and 5.9 wt % Al, between 1.1 and 1.6 wt % Ti, between 3 and 7 wt % Ta, between 0.01 and 0.3 wt % of C+Zr+B, between 0.05 and 1 wt % Hf, between 0.05 and 1 wt % Si, and between 0.01 and 0.2 wt % of the sum of rare earths such as Sc, Y, the actinides and the lanthanides. The composition is intended for use in hot components such as gas turbine blades, and the hot components are preferably produced by clean casting.

13 Claims, 1 Drawing Sheet

FOREIGN PATENT DOCUMENTS

| | | | |
|---|---|---|---|
| EP | 0 683 239 | A1 | 11/1995 |
| EP | 1 420 075 | A1 | 5/2004 |
| RU | 2088685 | C1 | 8/1997 |
| RU | 2149202 | C1 | 5/2000 |
| WO | WO 97/48827 | | 12/1997 |
| WO | WO 2005054528 | A1 | 6/2005 |
| WO | WO 2006/067189 | A1 | 6/2006 |

* cited by examiner

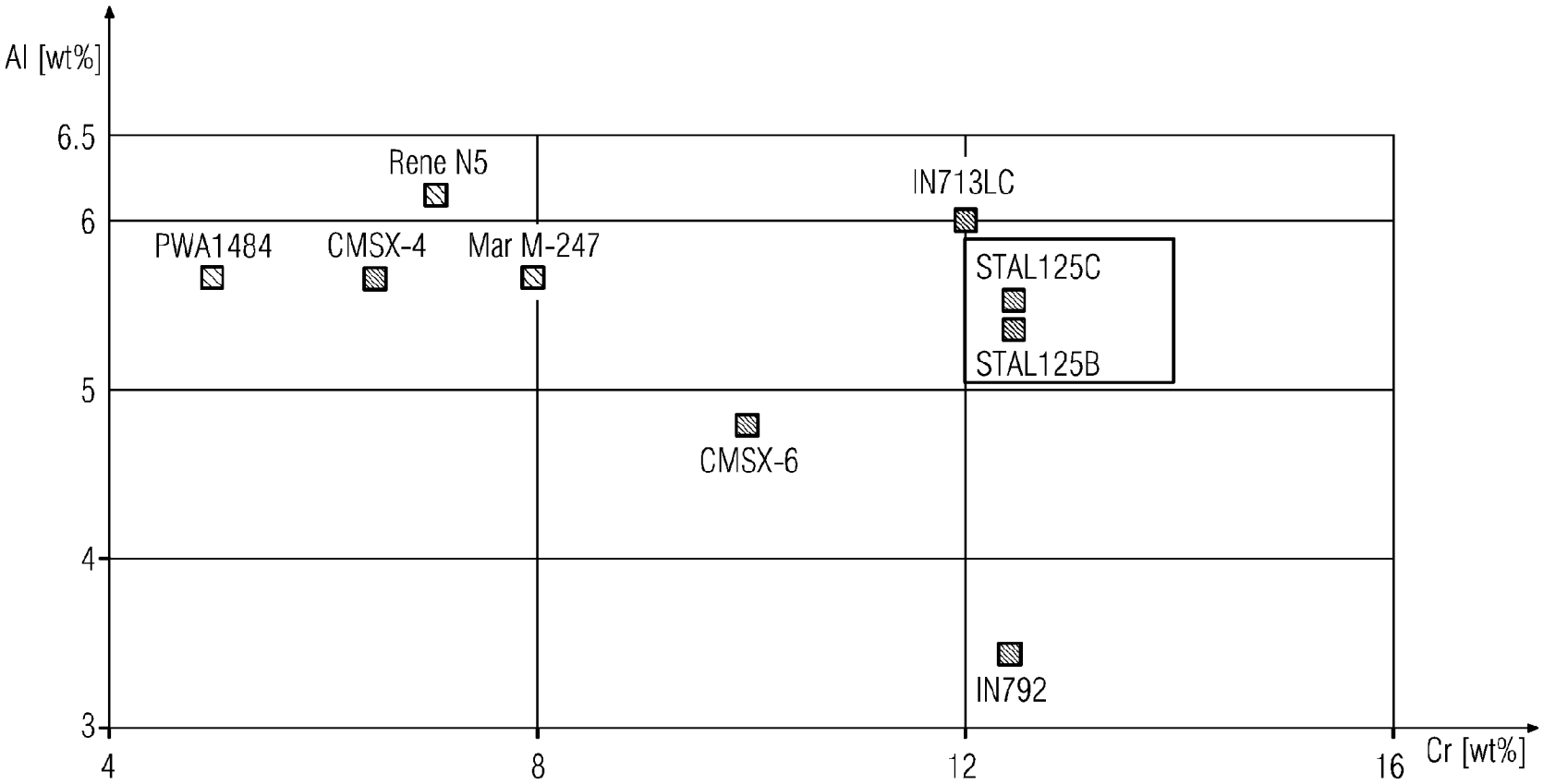
Al [wt%]
6.5
6
5
4
3
Cr [wt%]
4
8
12
16
Rene N5
PWA1484
CMSX-4
Mar M-247
IN713LC
STAL125C
STAL125B
CMSX-6
IN792

NICKEL BASE GAMMA PRIME STRENGTHENED SUPERALLOY

CROSS REFERENCE TO RELATED APPLICATIONS

This application is the US National Stage of International Application No. PCT/EP2009/058676, filed Jul. 8, 2009 and claims the benefit thereof. The International Application claims the benefits of European Patent Office application No. 08012691.5 DE filed Jul. 14, 2008. All of the applications are incorporated by reference herein in their entirety.

FIELD OF INVENTION

The present invention relates to a nickel-base gamma prime strengthened superalloy. It further relates to its use in hot components such as, but not restricted to, blades in gas turbines. It further relates to its use in equiaxed, directionally solidified or monocrystalline form.

BACKGROUND OF INVENTION

Gamma prime strengthened nickel-base superalloys are essential for critical components in aero and land based gas turbines, but, are used also in other applications. The difference between said superalloys depend on the level of knowledge and production technology available at the time they were developed, and, on different relative emphasis on properties such as hot corrosion resistance, oxidation resistance, coating compatibility, phase stability, creep strength and density.

Nickel-base gamma prime strengthened superalloys are used in monocrystalline, directionally solidified or equiaxed form. In each crystal there is a matrix of the phase gamma which is essentially Ni with elements like Co, Cr, Mo, W and Re in solid solution, and, particles of the phase gamma prime which is essentially Ni3Al with elements like Ti, Ta, Nb and V in solid solution. Grain boundaries, if present, are usually decorated by carbides and/or borides which provide cohesive strength. Zr and Hf also contributes to grain boundary cohesion.

Creep strength is provided by the elements Mo, W and Re which provide solution strengthening to the gamma matrix, and, Ti, Ta, Nb and V which provide solution strengthening to the gamma prime particles. Ta has a particularly high strengthening effect per at %. Also, Al provides creep strength because it increases the amount of gamma prime particles, and, because it concentrates the levels of Mo, W and Re in the matrix.

If the concentration of Cr, Mo, W and Re in the matrix is too high, so called topologically close packed (TCP) phases will form in service. Therefore, an increased gamma prime content, or, increased Mo, W or Re levels, must be accompanied by a reduction in Cr if extensive TCP formation is to be avoided. One particular effect of TCP precipitation is a reduction in creep strength.

[Caron 1] teaches that the tendency for TCP precipitation for an alloy can be estimated through comparison of the Md value for this alloy and a relatively similar alloy with known TCP risks. For the alloys analyzed here, the Md value can be calculated from $$Md=0.717aNi+0.787aCo+1.142aCr+1.55aMo+1.655aW+1.9aAl+2.271aTi+2.224aTa$$

wherein aCo is the content of Co in atom % etc.

Hot corrosion resistance is provided by Cr, and, the classical rule is that at least 12 wt % Cr is needed for adequate hot corrosion resistance. It is also important to allow at most moderate Mo levels.

[Goldschmidt] teaches that the hot corrosion resistance of the alloy SC16 with 16 wt % Cr and 3 wt % Mo is inferior to that of IN738LC with 16 wt % Cr and 1.8 wt % Mo. IN738LC is generally recognized as having a high hot corrosion resistance. Therefore a restriction to at most 2 wt % Mo in a new alloy seems prudent.

In the context of high firing temperature gas turbines it is generally accepted that high oxidation resistance require the ability to form an adherent continuous AL2O3 scale, as needed for metal temperatures on the 1000 degree Celcius level.

[Barrett] teaches that this ability is provided by Al, enhanced by Cr and Ta, somewhat reduced by Mo and W, reduced by Ti and Nb, and significantly reduced by V. This implies that less Al is needed to form such an Al2O3 scale if the levels of Cr and Ta are increased, or, the levels of Ti, Nb and V are reduced.

[Sarioglu] teaches that the scale adherence is severely reduced by tramp elements such as S, but, that this effect can be neutralized by a combination of clean casting and addition of small measured levels of reactive elements (RE) such as Zr, Hf and rare earths.

[Pint 1] underlines the importance of S, and further teaches the beneficial RE effects when small levels of Hf and the rare earth Y are combined.

[Caron 2] teaches the beneficial RE effects when small levels of Hf and Si are combined.

[Pint 2] teaches that optimal RE effects can be obtained when multiple RE are used, one example being the excellent cyclic oxidation resistance seen in tests on Haynes-214 which contained small levels of Zr, Si and Y.

One important aspect of coating compatibility particularly relevant for modern high firing temperature gas turbines is the cyclic life of an applied theimal barrier coating.

[Wahl&Harris] teaches that the spallation life of a TBC increased significantly when rare earths were added to the base alloy.

[Wu] teaches that the spallation life of a TBC can be correlated to the oxidation resistance of the base alloys. In particular, the lowest spallation life was obtained for the base alloy with the highest Ti content.

The density is reduced by the light elements Al and Ti, and increased by the heavy elements W, Re and Ta.

[Caron 1] teaches that for the alloys of interest for us, the density in kg/dm3 can be calculated from $$Density=8.29604-0.00435aCo-0.0164*aCr+0.01295aMo+0.06274aW-0.06595aAl-0.0236aTi+0.05441aTa$$

wherein aCo is the content of Co in atom % etc.

The used references can be found as follows:

[Caron 1] P. Caron High Gamma Prime Solvus New Generation Nickel-Based Superalloys for Single Crystal Turbine Blade Applications Proceedings 'Superalloys 2000'

[Goldschmidt] D. Goldschmidt Single-Crystal Blades Proc. from Materials for Advanced Power Engineering 1994, Part I, p. 661-6741

[Barrett] C. A. Barrett A Statistical Analysis of Elevated Temperature Gravimetric Cyclic Oxida¬ tion Data of 36 Ni- and Co-base Superalloys based on an Oxidation Attack Parameter NASA™ 105934

[Sarioglu] C. Sarioglu, et al. The Control of Sulfur Content in Nickel-Base Single Crystal Superalloys and its Effect on Cyclic Oxidation Resistance Proceedings 'Superalloys 1996'

[Pint 1] B. A. Pint et al Effect of Cycle Frequency on High-Temperature Oxidation Behavior of Alumina- and Chromia-Forming Alloys Oxidation of Metals, 58 (1/2), 73-101 (2002)

[Caron 2] P. Caron et al. Improvement of the Cyclic Oxidation Behaviour of Uncoated Nickel Based Single Crystal Superalloys Materials Proceedings 'Materials for Advanced Power Engineering 1994'

[Pint 2] B. A. Pint et al. The use of Two Reactive Elements to Optimize Oxidation Performance of Alumina-Forming Alloys Materials at High Temperature 20(3) 375-386, 2003

[Wahl&Harris] J. B. Wahl, K. Harris Advances in Single Crystal Superalloys—Control of Critical Elements Proceedings '7th Parsons conference', 2007

[Wu] R. Wu et al On the Compatibility of Nickel-Based Single Crystal Superalloys with Coating Systems Proceedings '7th Parsons conference', 2007

[Caron 3] P. Caron et al Development of New High Strength Corrosion Resistant Single Crystal Superalloys for Industrial gas Turbine Applications Proceedings '5th Parsons confer¬ ence', 2000

Early alloy development resulted in alloys such as IN713LC which has a composition, in wt %, given by Ni-12Cr-4.5Mo-6Al-0.6Ti-4Ta-0.1Zr-0.05C-0.01B, a particle content of about 55 vol %, and a low density of about 8.0 kg/dm3. Reliance on Mo for matrix strengthening is typical for these early alloys.

6 wt % Al supported by 12 wt % Cr, 4 wt % Ta and a reactive element effect from Zr enable high oxidation resistance. Despite 12 wt % Cr, the hot corrosion resistance is poor due to the high Mo level. The density is low thanks to low levels of heavy elements.

One line of subsequent alloy development led to alloys such as IN792 which has a composition, in wt %, given by Ni-9Co-12.5Cr-1.8Mo-4.2W-3.4Al-4.2Ti-4.2Ta-0.08C-0.015B, a particle content of about 50 vol %, and a moderate density of 8.25 kg/dm3.

Compared to IN713LC, Mo is partly replaced by W for improved hot corrosion resistance, and, Al is partly replaced by Ti for improved solution strengthening of the particles. High Ti levels is typical for these alloys.

Replacement of Mo by W increases the density. Due to the partial replacement of Al by Ti these alloys are unable to form Al2O3 scales, therefore they do not provide high oxidation resistance.

Another line of subsequent alloy development led to alloys like CMSX-4 which has a composition, in wt %, of Ni-9Co-6.5Cr-0.8Mo-6.5W-3Re-5.65Al-1.2Ti-6Ta-0.1Hf, a particle content of about 70 vol %, and a high density of 8.67 kg/dm3. These alloys combine very high particle contents with very high levels of matrix strengthening elements, which has forced the Cr levels to very low levels to avoid TCP precipitation.

High levels of Al and Ta and low levels of Ti and Nb enable high oxidation resistance and good coating compatibility despite low Cr levels. Significant work has been done to further enhance their oxidation resistance and coating compatibility via clean casting and use of RE effects. Their hot corrosion resistance is poor due to their low Cr levels.

A further line of alloy development led to alloys such as CMSX-6 which has a composition, in wt %, given by Ni-5Co-10Cr-3Mo-4.8Al-4.7Ti-2Ta-0.1Hf, a particle content of about 60 vol %, and a very low density of 7.83 kg/dm3.

These alloys are characterized by high levels of Al and Ti, less than 12 wt % Cr, and reliance on Mo rather than Re or W for matrix strengthening. The combination of less than 12 wt % Cr, and, reliance on only Mo for matrix strengthening, result in a less than adequate hot corrosion resistance. Furthermore, the high Ti levels prohibit high oxidation resistance and coating compatibility despite relatively high Al levels.

SUMMARY OF INVENTION

None of the alloys above provide a blend of adequate corrosion resistance, high oxidation resistance, high coating compatibility, adequate phase stability, adequate creep resistance, and low density, and it is an objective of this invention to provide such a blend.

This blend of properties will e.g. be useful for design of hot stage blades which require robustness w.r.t. oxidation and corrosion, and for which the loading on the disc is the critical issue w.r.t. stress lifing.

We are essentially restarting with IN713LC. Then we reduce the amount of matrix strengthening elements in atom % somewhat to enable increased Cr levels, and partly replace Mo by W, in order to improve the hot corrosion resistance. Further, we replace Al with Ti to a limited extent to enable a higher level of strengthening of the particles. However, we only use Mo and Ti at levels at which they do not significantly reduce the hot corrosion and oxidation resistance respectively. Further, we prescribe clean casting and the use of multiple reactive elements to enhance oxidation resistance and coating compatibility. Further, we add the ability to use directional solidification and single crystal casting to enhance the mechanical properties.

According to one embodiment of the invention the alloy may include, measured in wt %, up to 20 wt % Co, between 12 and 14 wt % Cr, between 1 and 2 wt % Mo, between 1.4 and 2.8 wt % W, between 5.1 and 5.9 wt % Al, between 1.1 and 1.6 wt % Ti, between 3 and 7 wt % Ta, between 0.01 and 0.3 wt % of C+Zr+B, between 0.05 and 1 wt % Hf, between 0.05 and 1 wt % Si, and between 0.01 and 0.2 wt % of the sum of rare earths such as Sc, Y, the actinides and the lanthanides.

Additionally, the alloy may include, between 4 and 6 wt % Co, between 12.3 and 12.7 wt % Cr, between 1.3 and 1.7 wt % Mo, between 2.2 and 2.8 wt % W, between 5.2 and 5.4 wt % Al, between 1.1 and 1.3 wt % Ti, between 5.1 and 5.5 wt % Ta, between 0.01 and 0.03 wt % C, between 0.07 and 0.13 wt % Hf, between 0.07 and 0.13 wt % Si, and between 0.02 and 0.04 wt % of Ce+La+Y.

Additionally, in a preferred embodiment called STAL125B, the alloy may include about 5 wt % Co, about 12.5 wt % Cr, about 1.5 wt % Mo, about 2.5 wt % W, about 5.3 wt % Al, about 1.2 wt % Ti, about 5.3 wt % Ta, about 0.02 wt % C, about 0.1 wt % Hf, about 0.1 wt % Si, and about 0.03 wt % Ce.

Alternatively, the alloy may include, between 4 and 6 wt % Co, between 12.3 and 12.7 wt % Cr, between 1.4 and 1.8 wt % Mo, between 1.6 and 2.0 wt % W, between 5.4 and 5.6 wt % Al, between 1.4 and 1.6 wt % Ti, between 3.3 and 3.7 wt % Ta, between 0.01 and 0.03 wt % C, between 0.07 and 0.13 wt % Hf, between 0.07 and 0.13 wt % Si, and between 0.02 and 0.04 wt % of Ce+La+Y.

Additionally, in a preferred embodiment called STAL125C, the alloy may include about 5 wt % Co, about 12.5 wt % Cr, about 1.6 wt % Mo, about 1.8 wt % W, about 5.5 wt % Al, about 1.5 wt % Ti, about 3.5 wt % Ta, about 0.02 wt % C, about 0.1 wt % Hf, about 0.1 wt % Si, and about 0.03 wt % Ce.

The preferred embodiments above are primarily aimed at monocrystalline casting as they only contain grain boundary strengthening elements at levels appropriate to strengthen low angle boundaries.

Alternatively, further embodiments can be designed to e.g. optimize compatibility with specific coatings, or, for directional or equiaxed solidification.

The superalloy according to the invention is preferably processed with clean casting. To guarantee best results, the superalloy should contain less than 2 ppmw S.

The particle contents for an equilibrium temperature of 900 degree Celcius as calculated by the well-known ThermoCale system are about 55 vol % for STAL125B and STAL125C.

The density values for STAL125B and STAL125C as calculated by the Caron formula above are 8.15 and 8.00 kg/dm3 respectively.

BRIEF DESCRIPTION OF THE DRAWINGS

The above mentioned attributes and other features and advantages of this invention will become more apparent by reference to the following description taken in conjunction with the accompanying drawings, wherein:

FIG. 1 is a two dimensional diagram comparing the weight-content of Chromium and Aluminum of different alloys.

DETAILED DESCRIPTION OF INVENTION

FIG. 1 illustrates a part of the Cr—Al plane covered by the present invention, and how it provides a potential for adequate hot corrosion resistance and high oxidation resistance. This potential is realized through a sound composition, i.e. low levels of Mo and Ti, zero Nb and V, low S casting and use of reactive elements. It also illustrates the state-of-the-art in comparison.

The nomenclature of the referenced compositions corresponds to the above mentioned alloys.

CMSX-4 (known also from U.S. Pat. No. 4,643,782) has a composition, in wt %, of Ni-9Co-6.5Cr-0.8Mo-6.5W-3Re-5.65Al-1.2Ti-6Ta-0.1Hf, a particle content of about 70 vol %, and a high density of 8.67 kg/dm3.

IN713LC has a composition, in wt %, given by Ni-12Cr-4.5Mo-6Al-0.6Ti-4Ta-0.1Zr-0.05C-0.01B, a particle content of about 55 vol %, and a low density of about 8.0 kg/dm3.

CMSX-6 which has a composition, in wt %, given by Ni-5Co-10Cr-3Mo-4.8Al-4.7Ti-2Ta-0.1Hf, a particle content of about 60 vol %, and a very low density of 7.83 kg/dm3.

From CH 637 165, EP 0208645 and "Second generation nickel-base superalloy", A. D. Cetel et al., Superalloys 1988, ed. S. Reichman et al, Met. Soc, 1988, S. 235, "PWA 1484" is known.

From EP 0076360 and U.S. Pat. No. 5,270,123 the alloy Rene N5 is known.

WO/1997/048827, 'NICKEL-BASE SUPERALLOY' discloses the alloy MarM-247.

IN792 is described in 'G. Pitz, T. Beck, K.-H. Lang, D. Löhe, 'Thermisch-mechanisches and isothermes Ermüdungsverhalten der Nickelbasis—Superlegierung IN 792 CC'.

STAL125C and STAL125B is obtained with the before mentioned advantages as described above.

CMSX-4 and CMSX-6 have a too low Cr-content for adequate hot corrosion resistance. IN713LC has a too high Mo-content, which leads to an insufficient hot corrosion resistance. IN792 however has a too low Al-content, which leads to insufficient oxidation resistance. STAL125B and STAL125C have adequate hot corrosion resistance and high oxidation resistance through low Mo and Ti, zero Nb and V, low S and RE.

The invention claimed is:

1. A nickel base gamma prime strengthened superalloy, consisting of (in a wt %):
up to 20 wt % Co;
12-14 wt % Cr;
1-2 wt % Mo;
1.4-2.8 wt % W;
5.1-5.9 wt % Al;
1.1-1.6 wt % Ti;
3-7 wt % Ta;
0.01-0.3 wt % of C+Zr+B;
0.05-1 wt % Hf;
0.05-1 wt % Si; and
0.01-0.2 wt % of rare earths.

2. A nickel base gamma prime strengthened superalloy according to claim 1, wherein at least one of the rare earths are selected from the group, Sc, Y, actinides and lanthanides.

3. A nickel base gamma prime strengthened superalloy according to claim 1 consisting of (in a wt. %):
4-6 wt % Co;
12.3-12.7 wt % Cr;
1.3-1.7 wt % Mo;
2.3-2.7 wt % W;
5.2-5.4 wt % Al;
1.1-1.3 wt % Ti;
5.1-5.5 wt % Ta;
0.01-0.03 wt % C;
0.07 and 0.13 wt % Hf;
0.07 and 0.13 wt % Si; and
0.02-0.04 wt % of Ce+La+Y.

4. A nickel base gamma prime strengthened superalloy according to claim 3, consisting of:
essentially 5 wt % Co;
essentially 12.5 wt % Cr;
essentially 1.5 wt % Mo;
essentially 2.5 wt % W;
essentially 5.3 wt % Al;
essentially 1.2 wt % Ti;
essentially 5.3 wt % Ta;
essentially 0.02 wt % C;
essentially 0.1 wt % Hf;
essentially 0.1 wt % Si; and
essentially 0.03 wt % Ce.

5. A nickel base gamma prime strengthened superalloy according to claim 1 consisting of:
4-6 wt % Co;
12.3-12.7 wt % Cr;
1.4-1.8 wt % Mo;
1.6-2.0 wt % W;
5.4-5.6 wt % Al;
1.4-1.6 wt % Ti;
3.3-3.7 wt % Ta;
0.01-0.03 wt % C;
0.07-0.13 wt % Hf;
0.07-0.13 wt % Si; and
0.02-0.04 wt % of Ce+La+Y.

6. A nickel base gamma prime strengthened superalloy according to claim 5 consisting of:
essentially 5 wt % Co;
essentially 12.5 wt % Cr;
essentially 1.6 wt % Mo;
essentially 1.8 wt % W;
essentially 5.5 wt % Al;
essentially 1.5 wt % Ti;
essentially 3.5 wt % Ta;
essentially 0.02 wt % C;
essentially 0.1 wt % Hf;
essentially 0.1 wt % Si; and
essentially 0.03 wt % Ce.

7. A nickel base gamma prime strengthened superalloy according to claim 1, wherein the superalloy is processed with clean casting resulting in less than 2 ppm S.

8. The nickel base gamma prime strengthened superalloy according to claim 1, wherein the superalloy is in monocrystalline form.

9. The nickel base gamma prime strengthened superalloy according to claim 1, wherein the superalloy is in directionally solidified form.

10. The nickel base gamma prime strengthened superalloy according to claim 1, wherein the superalloy is in equiaxed form.

11. The nickel base gamma prime strengthened superalloy according to claim 1, wherein the superalloy is used as a hot component of a machine.

12. The nickel base gamma prime strengthened superalloy according to claim 11, wherein the hot component is a gas turbine component.

13. The nickel base gamma prime strengthened superalloy according to claim 12, wherein the gas turbine component is a blade.

* * * * *